United States Patent [19]

Wardwell et al.

[11] 4,099,643

[45] Jul. 11, 1978

[54] SEAL FOR FLOATING ROOF TANK

[75] Inventors: John Albert Wardwell; Ray Alan Stewert, both of Torrance; Ralph Gee Chow, Tarzana, all of Calif.

[73] Assignee: Mobil Oil Corporation, New York, N.Y.

[21] Appl. No.: 799,015

[22] Filed: May 20, 1977

[51] Int. Cl.[2] ..... B65D 87/20

[52] U.S. Cl. ..... 220/222; 220/226

[58] Field of Search ..... 220/216–227

[56] References Cited

U.S. PATENT DOCUMENTS

| | | | |
|---|---|---|---|
| 2,108,380 | 2/1938 | Lentschewsky | 220/224 |
| 2,427,171 | 9/1947 | Wiggins | 220/222 |
| 2,459,178 | 1/1949 | Moyer | 220/224 |
| 2,551,403 | 5/1951 | Wiggins et al. | 220/222 |
| 2,897,998 | 8/1959 | Ulm | 220/224 |
| 3,043,468 | 7/1962 | Horner, Jr. | 220/226 |
| 3,275,183 | 9/1966 | Challenger | 220/222 |
| 3,422,981 | 1/1969 | McBrien et al. | 220/224 |

FOREIGN PATENT DOCUMENTS

| | | | |
|---|---|---|---|
| 1,164,914 | 10/1958 | France | 220/220 |
| 584,280 | 8/1933 | Fed. Rep. of Germany | 220/226 |
| 815,105 | 6/1959 | United Kingdom | 220/222 |
| 929,723 | 6/1963 | United Kingdom | 220/226 |

*Primary Examiner*—Stephen Marcus

*Attorney, Agent, or Firm*—Charles A. Huggett; Michael G. Gilman; Raymond W. Barclay

[57] ABSTRACT

Auxilliary seal for a floating roof tank is provided by a plurality of superposed flexible sheet members arranged above a primary seal about the periphery of the floating roof. The flexible sheet members have outer edges which distort as the assembly passes over rivet heads, butt straps or other protrusions from the inner surface of the tank wall and thus provide the desired seal. The flexible elements also readily accommodate to deviations of the wall from truly circular.

1 Claim, 4 Drawing Figures

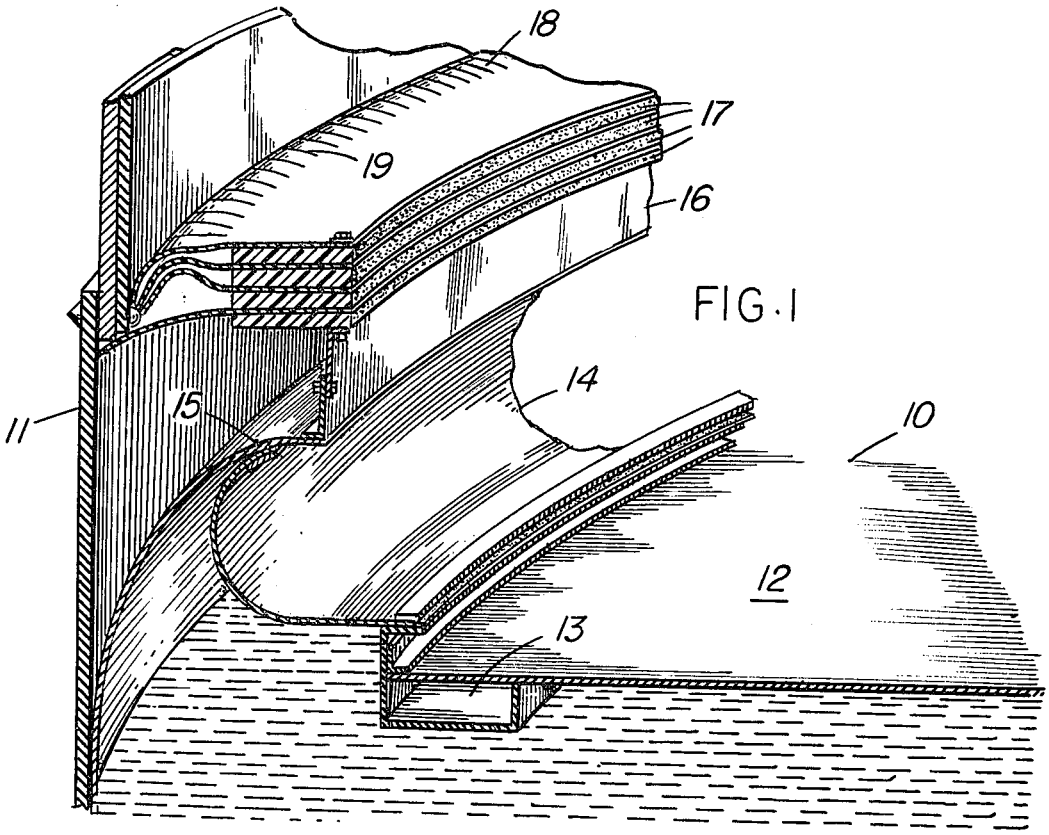
FIG. 1
FIG. 2
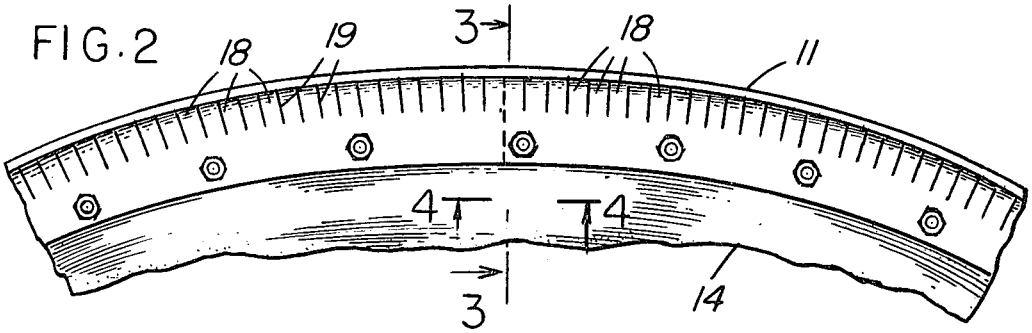
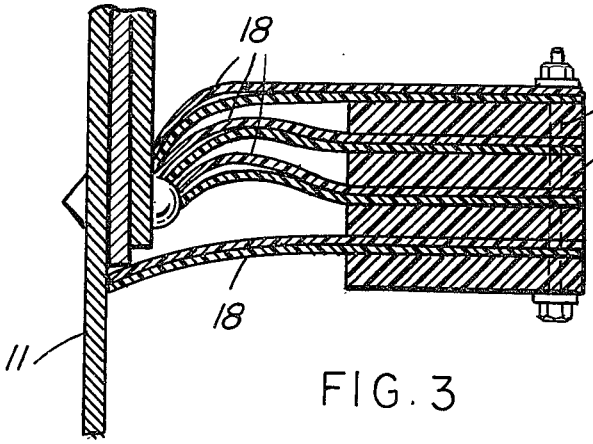
FIG. 3
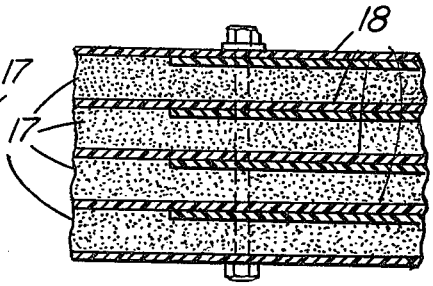
FIG. 4

SEAL FOR FLOATING ROOF TANK

FIELD OF THE INVENTION

The invention is concerned with floating roof storage tanks for volatile liquid products such as light crude oils, motor and aviation gasoline and jet fuels. Such tanks are adapted to operate with minimal vapor space because the roof floats on the contained liquid product because of its buoyance. That property may be provided by constructing the roof as a flat metal deck having sealed compartments (pontoons) on its lower surface. Alternatively, the roof may be a single flotation compartment defined by upper and lower decks joined at the circumference by a vertical cylindrical wall. Floating roofs therefore restrict evaporation losses to the minor area of liquid surface between the wall of the tank and the circumference of the roof. Evaporation losses from this minor area are customarily restricted by sealing elements fixed to the circumference of the roof and bearing against the inner surface of the tank wall. The invention is particularly directed to provision of an improved vapor seal.

BACKGROUND OF THE INVENTION

Tankage is an important feature of any facility handling large quantities of liquid such as a petroleum refinery which may process several hundred thousand barrels per day of petroleum to manufacture a full slate of petroleum products ranging from liquefied petroleum gas (LPG or "bottled gas") through gasolines, kerosines and light fuel oil to heavy bunker oil (No. 6), asphalts and heavy lubricants. To maintain continuity of operation there must be a reserve of crude petroleum held in tanks and there must be storage for intermediate (e.g. gasoline components) and finished products of all types. The varied nature of material stored imposes a number of varied storage problems.

The simplest type of tank is constituted by a cylindrical wall and a roof in the form of a cone, generally termed "cone roof" tank. Such tanks are suitable for storage of low volatility crude oil and products.

Even at low volatility of the stored liquid, evaporation losses are substantial when the liquid is stored in standard tanks with gastight steel roofs. The cycles of temperature change from night to day and with the season generates a condition known as "breathing" of the gas volume above the liquid surface. The gas volume contracts on cooling and air is drawn into the vessel. Conversely, a rise in temperature will expand the gas volume, forcing the vapor-saturated air out through the tank vents. In each cycle, the gas phase reaches equilibrium with the stored liquid. On exhalation, some of the light ends of the stored product are carried away.

Losses of product also result from filling and withdrawal of product. When liquid is dispensed from a storage tank, air enters through the vents. When again filled, the air is forced out, again carrying light vapors with it. These filling losses are usually less than breathing losses, but can be significant, particularly in tankage subjected to a high rate of turn-over by frequent dispensing and refilling.

A variety of conservation means are available for reduction in losses of product by discharge of air saturated with volatile components of the stored liquid. The vents of cone roof tanks can be provided with pressure-vacuum valves. Such conservation vent imposes slight pressure on contents of the tank to inhibit exhalation until the tank pressure exceeds the valve setting. As tank contents cool, tending to inhalation, the valve opens when its vacuum setting is exceeded. Some products are stored in vessels designed to withstand the vapor pressure of the contents. Such pressure storage facilities are often of spherical or spheroidal shape. Other tankage is designed to adapt to volume change of the vapor by change in volume of the space enclosed by any of several devices of which the common gas holder is exemplary.

A conservation tank of particular choice is a cylindrical tank having an upper closure which floats on the liquid contents, the so-called floating roof tank. This class of tankage includes the original pan-type tank roof which has been largely superseded by the pontoon and double-pontoon types. In the double-deck type, the pontoons cover the entire area of liquid surface. With no air-vapor space above the liquid, evaporation losses are limited to those caused by the small peripheral exposure at the seals. Such a tank eliminates 90 to 95 percent of the evaporation losses.

There is practically no filling loss with floating roof tanks. For that reason, these tanks are most advantageous for the storage of volatile products at locations where extensive product movement is anticipated.

The pontoon type of floating roof is quite stable. The double-deck type is even more stable and practically eliminates possibility of boiling from solar heat applied to the deck. In addition to control of losses due to evaporation and filling, the floating roof type of closure eliminates moisture due to condensation from inhaled moist air and thus reduces corrosion problems. The lack of vapor space above the oil surface greatly reduces fire risks.

Inherent in the floating roof design is a narrow annular space between the periphery of the roof and the wall of the tank. This space must be great enough to accomodate for protrusions on the inner surface of the tank wall such as rivet heads and butt straps, as well as minor deviations of the tank wall from truly round. It is usual practice to provide elements for sealing this space in the form of depending skirts biased to press against the wall, resilient pads and the like. Due to irregularities of the wall surface, wear on the seal elements and like causes, the seal is not complete and some evaporation does occur with resultant loss of product and some cases, such as motor gasoline, product quality is adversely affected.

Such evaporation as may take place from floating roof tanks involves the lighter hydrocarbons of the stored liquid. In motor gasoline, these fractions are responsible for easy starting of internal-combustion engines and have a favorable influence on the anitknock properties of motor fuels. One authority reports that a volumetric loss of 1.0 percent from a typical gasoline results in a rise of 5° F. in the 10 percent point of the distillation curve; a decrease of 0.5 psi in Reid vapor pressure, and a 1-point loss in the octane rating of the fuel.

SUMMARY OF THE INVENTION

The invention provides novel seal elements for floating roof tanks in the form of a plurality of superposed and spaced apart flexible sheets extending outwardly about the periphery of the floating roof to bear against the tank wall. By reason of their resilience, these members will maintain contact with the tank wall except at the immediate vicinity of an irregularity which flexes the edge of the sheet in contact with the wall. By providing a plurality of spaced, superposed members of this nature, the invention affords inhibition of evaporation loss even though one element may be flexed, as on a rivet head, sufficiently to provide an opening. Preferably, the present seal is employed as auxiliary to the conventional seals of depending metal skirts, resilient pads and the like. For that purpose, the present seal is preferably mounted above the deck of the floating roof and thereby confines a small annular vapor space about the periphery of the deck and above the primary seals.

DESCRIPTION OF DRAWINGS

A suitable arrangement for accomplishing these objectives of the invention is shown in the annexed drawings, wherein:

FIG. 1 is a fragmentary section in elevation of a preferred embodiment of the invention;

FIG. 2 is a fragmentary plan view of the auxiliary seal;

FIG. 3 is a section on line 3—3 of FIG. 2; and

FIG. 4 is a section on line 4—4 of FIG. 2.

DESCRIPTION OF PREFERRED EMBODIMENT

As shown in FIG. 1, the auxiliary seal of this invention is mounted upon the upper periphery of a floating roof indicated generally at 10 within the wall 11 of a cylindrical tank. The roof 10 is primarily constituted by a flat steel deck 12 which is rendered buoyant by pontoon 13 integral therewith. A primary seal 14 fastened to the edge of deck 12 carries at its upper end a skirt 15 depending there from to contact wall 11. The skirt 15 is resiliently pressed against the inner surface of wall 11 about the entire circumference of the tank at a level below the surface of the stored liquid.

A bracket 16 is mounted above the skirt 15 to provide a circular support above deck 12 for the auxiliary seal provided by this invention. The bracket 16 supports a plurality of alternate spacing blocks 17 and wiper members or fingers 18, arranged as shown.

In a typical installation for a riveted steel plate tank having a nominal capacity of 134,000 barrels, the auxiliary seal of this invention is provided by spacers and wiper fingers of neoprene. The tank has a diameter of 144 feet, 46 feet high. The auxiliary seal assembly is constituted by spacer blocks 17 of arcuate form $\frac{3}{4}$ inch thick, 5 inches wide and 3 feet 8 inches long. The spacer blocks 17 are of neoprene foam. Arcuate sheets of neoprene gasket material form wiper fingers 18. These are $\frac{1}{8}$ inch thick, 9 inches wide and 4 feet, $4\frac{1}{2}$ inches long to provide the overlap seen in FIGS. 3 and 4 of wipers 18 as compared with the butt joints of spacer blocks 17. It will be seen that these dimensions afford enough overlap of adjacent ends of wipers that the auxiliary seal will be fully effective. It will also be clear that the 9 inch wide fingers 18 will project 4 inches beyond the spacer blocks 17.

The neoprene gasket material has slits 19, 3 inches long and spaced $\frac{3}{4}$ inches, for the entire length of the seal to afford individual action of fingers of $\frac{3}{4}$ inches width over protrusions such as rivet heads, lap joints, and butt straps.

We claim:

1. In a floating roof tank having a vertical wall of circular shape adapted to contain a stored volatile liquid, a buoyant roof floating on said stored liquid and extending to the interior side of said wall and a dependent sealing element extending downwardly from the periphery of said roof to engagement with said wall, an auxiliary seal mounted on the periphery of the upper surface of said roof and spaced above said dependent sealing element thus defining a vapor space between said dependent sealing element and said auxiliary seal, said auxiliary seal being constituted by a plurality of substantially horizontal layers each constituted by a plurality of segments of which the adjacent ends are overlapped, said layers being vertically spaced one from the other and having the edges thereof remote from said roof in engagement with said wall, and closure means connecting the inner edges of said layers to said roof adapted to inhibit leakage from spaces defined by said layers;

the improvement wherein the said horizontal layers are radially slit from the edges thereof adjacent said wall to a region intermediate said edges and said closure means to form a plurality of radial fingers engaging said wall.

* * * * *